United States Patent [19]

Breslow et al.

[11] Patent Number: 4,927,156

[45] Date of Patent: May 22, 1990

[54] PROPERTY DEALING GAME

[75] Inventors: Jeffrey D. Breslow, Highland Park; John V. Zaruba, Chicago; Donald A. Rosenwinkel, Oak Park, all of Ill.

[73] Assignee: Breslow, Morrison, Terzian & Associates, Inc., Chicago, Ill.

[21] Appl. No.: 307,331

[22] Filed: Feb. 6, 1989

[51] Int. Cl.[5] ..... A63F 3/00

[52] U.S. Cl. ..... 273/256; 273/278; 273/281

[58] Field of Search ..... 273/243, 254, 256, 278, 273/281, 282, 287, 289, 290

[56] References Cited

U.S. PATENT DOCUMENTS

| | | | |
|---|---|---|---|
| 2,026,082 | 8/1935 | Darrow | 273/256 |
| 3,468,540 | 9/1969 | Mulligan | 273/256 |
| 4,109,917 | 8/1978 | Hatcher | 273/254 |
| 4,140,319 | 2/1979 | Aycock et al. | 273/256 |
| 4,386,778 | 6/1983 | Hall | 273/256 |
| 4,456,259 | 6/1984 | Antal et al. | 273/256 |
| 4,522,407 | 6/1985 | Hatherley | 273/256 |
| 4,566,697 | 1/1986 | Vickers | 273/256 X |
| 4,824,118 | 4/1989 | Fusaro et al. | 273/256 |

*Primary Examiner*—Edward M. Coven
*Assistant Examiner*—William E. Stoll
*Attorney, Agent, or Firm*—John S. Pacocha

[57] ABSTRACT

A property dealing game that is played in two phases requires the players to acquire properties without always actually knowing the intrinsic value of the property. Cards are provided which, in combination with one or more properties, make the property worth more than its intrinsic value to a player holding one or more particular cards. The intrinsic value of the property is determined by the amount of money inserted into a closed property box during the course of play. In the initial phase, players proceed around peripheral pathway spaces on a board. However, in the second, less structured phase, the winner is determined as a result of deals made among the players without moving around the board. Additional cards are provided for affecting the holding of opposing players and influencing the bidding play in the acquisition of properties.

10 Claims, 2 Drawing Sheets

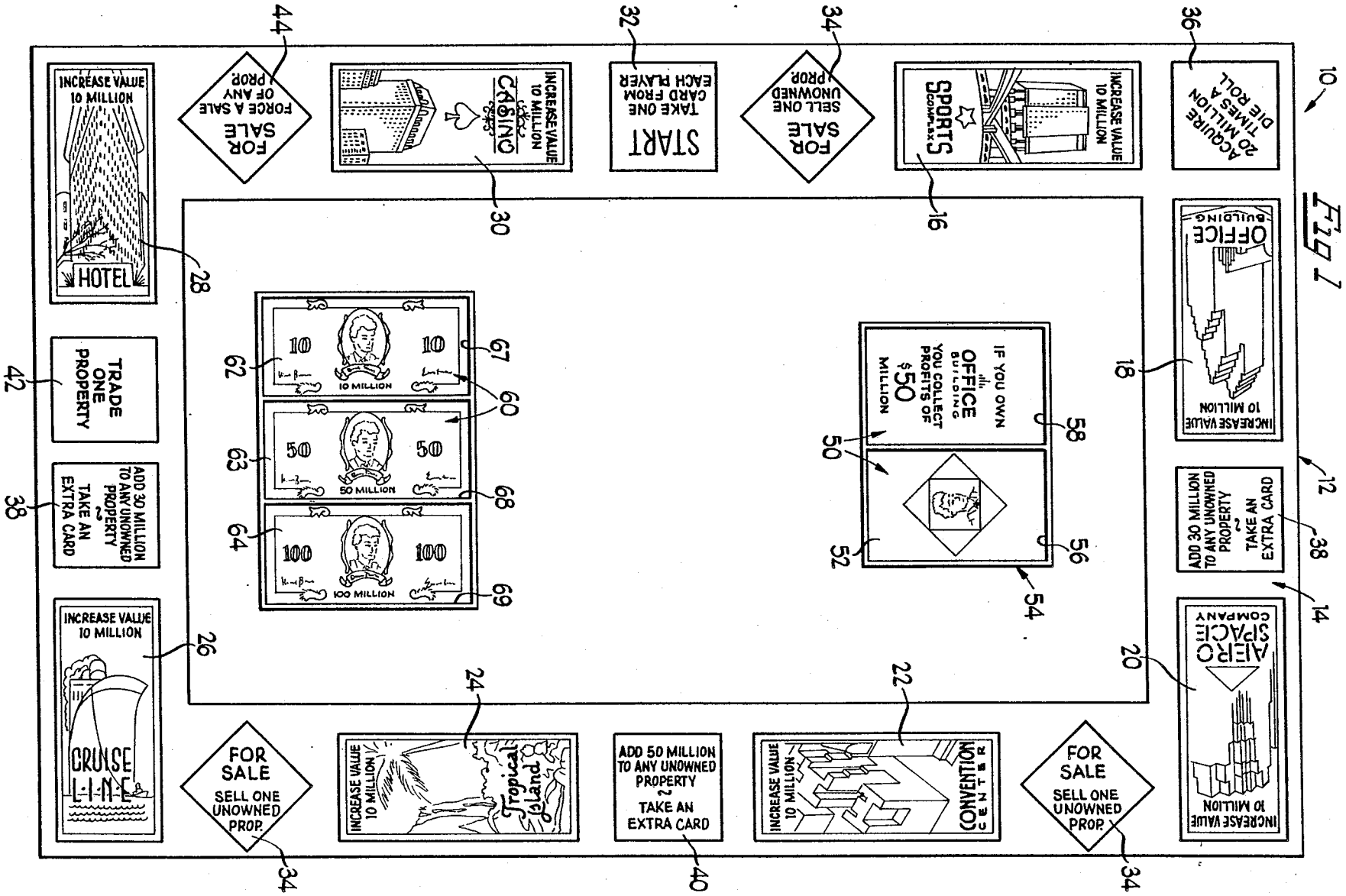
Fig 1
10
12
14
16
18
20
22
24
26
28
30
32
34
36
38
40
42
44
50
52
54
56
58
60
62
63
64
67
68
69
ACQUIRE 20 MILLION TIMES A DIE ROLL
OFFICE BUILDING
INCREASE VALUE 10 MILLION
ADD 30 MILLION TO ANY UNOWNED PROPERTY ? TAKE AN EXTRA CARD
AIERO SPACE COMPANY
INCREASE VALUE 10 MILLION
INCREASE VALUE 10 MILLION
SPORTS COMPLEX
FOR SALE SELL ONE UNOWNED PROP.
IF YOU OWN OFFICE BUILDING YOU COLLECT PROFITS OF $50 MILLION
CONVENTION CENTER
INCREASE VALUE 10 MILLION
FOR SALE SELL ONE UNOWNED PROP.
START TAKE ONE CARD FROM EACH PLAYER
ADD 50 MILLION TO ANY UNOWNED PROPERTY ? TAKE AN EXTRA CARD
INCREASE VALUE 10 MILLION
CASINO
Tropical Island
INCREASE VALUE 10 MILLION
10 MILLION
50 MILLION
100 MILLION
FOR SALE FORCE A SALE OF ANY PROP.
FOR SALE SELL ONE UNOWNED PROP.
INCREASE VALUE 10 MILLION
HOTEL
TRADE ONE PROPERTY
ADD 30 MILLION TO ANY UNOWNED PROPERTY ? TAKE AN EXTRA CARD
INCREASE VALUE 10 MILLION
CRUISE LINE

PROPERTY DEALING GAME

BACKGROUND OF THE INVENTION

1. Field of the Invention

This invention relates generally to games and more particularly to games in which players deal in properties.

2. Background Art

Games, particularly board games, in which players buy and sell things are old in the game art. Perhaps the best known prior art property dealing game is Parker Brothers' "MONOPOLY" Game which is disclosed in U.S. Pat. No. 2,026,082 issued Dec. 31, 1935 to Darrow. In that game, players proceed around the board's peripheral path by die roll and/or card instruction. If the player lands on an unowned piece of property, the player may purchase the property. However, if the property is owned and unmortgaged, the player must pay rent to the owner. After all of the properties are acquired, players continue to move around the board and may make deals with each other to acquire additional properties. The value of each of the properties is predetermined and known by all players. For each property, the purchase price, mortgage value and rent are printed on "deed" cards. Only two of the twenty-eight properties have some unknown element of value; namely, the rent which is an amount times a die roll. In the art auction game disclosed in U.S. Pat. No. 3,679,210 issued July 25, 1972 to Breslow, value cards selected at random are clipped to the back of simulated works of art to set their value for the duration of the game, with the value remaining concealed to all but the owner until the end of the game. Unknown value is an important element in two other prior art games in which players strive to obtain treasure chests, not knowing the actual contents of the treasure chests. These two games are disclosed in U.S. Pat. Nos. 4,656,943 issued Jan. 24, 1928 to Firestone and 4,569,527 issued Feb. 11, 1986 to Rosenwinkel et al. There remains a need, however, for a property dealing game in which there is an element of uncertainty as to the value of the property being acquired and which provides the opportunity for a second, less structured deal making phase of play.

SUMMARY OF THE INVENTION

The present invention is concerned with providing a game in which players bid for properties without always knowing the intrinsic value of the property which is determined by the amount of money inserted during the course of play into a closed box for the property. Cards are provided which, in combination with one or more properties, make the property worth more than its intrinsic value to a player holding one or more particular cards. Following an initial property acquisition phase in which players proceed around peripheral pathway spaces on a board, play of the game enters into a second, less structured phase in which the winner is determined as a result of deals made among players without moving around the board. Additional cards are provided for affecting the holdings of opposing players and influencing the bidding play in the acquisition of properties.

BRIEF DESCRIPTION OF THE DRAWINGS

For a better understanding of the present invention, reference may be had to the accompanying drawings in which:

FIG. 1 is a top plan view of parts of an embodiment of the present invention;

DETAILED DESCRIPTION OF THE PREFERRED EMBODIMENT

Figure 2:
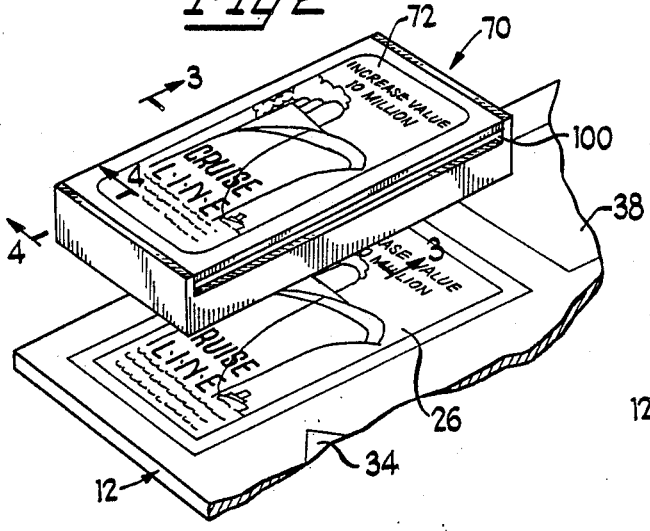
FIG. 2 is an enlarged scale, fragmentary perspective view of part of the board and a box used in the embodiment.

Referring now to the drawings in which like parts are designated by like reference numerals throughout the several views, FIG. 1 shows a game 10 including a board 12 that is generally rectangular and has a peripheral path 14. There is a total of eighteen spaces around the path including eight generally rectangular, property spaces with different graphics representing a sports complex 16, office building 18, an aerospace company 20, a convention center 22, a tropical island 24, a cruise line 26, a hotel 28 and a casino 30.

In addition to a start space 32, there are nine other instructional spaces dispersed along path 14 with at least one of the instructional spaces between each two adjacent property spaces. The instructional spaces include three "For Sale—Sell Any Unowned Property" spaces 34, one "Acquire Twenty Million Times A Die Roll" space 36, two "Add Thirty Million To Any Unowned Property" spaces 38, one "Add Fifty Million To Any Unowned Property" space 40, one "Trade One Property" space 42 and one "For Sale—Force The Sale Of Any Property" space 44. As illustrated in FIG. 1, instructional spaces 32–44 are generally square as distinguished from generally rectangular property spaces 16–30. All four "For Sale" spaces 34 and 44 are further distinguished by orienting them as diamonds.

The game also includes a deck of seventy-two cards 50 all having an identical back 52. During play of the game, cards 50 are picked from a face down stack and are discarded face up; to facilitate such use of cards 50, a tray 54 that is divided into a pair of side-by-side sections 56 and 58 is provided. Section 56 conveniently receives the pick or draw pile and section 58 receives the discards. Tray 54 is removable from board 12.

Simulated paper money 60 is also included in the game. The money is divided into three different denominations; namely $10 Million bills 62, $50 Million bills 63 and $100 Million bills 64. To facilitate the storage of the money, a bank tray 66 having three identical sections 67, 68 and 69 to accommodate the different denominations is conveniently provided. Bank tray 66, like card tray 54 is removable from the board.

Figure 5:
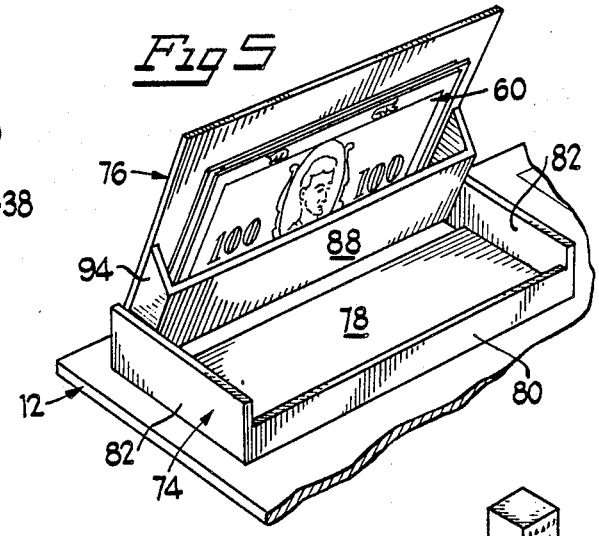
FIG. 5 is a fragmentary perspective view of the same part of the board and box shown in FIG. 2 but with the box open.

Eight opaque, rectangular property boxes 70 are also included in game 10. Each box 70 is identical in size, shape and construction. One of each of the boxes is designated by graphics 72 to conform with a particular one of property spaces 16–30. As illustrated in FIGS. 2 and 5, the length and width of property box 70 substantially conforms to the rectangular outline of the property space.

Each box or container 70 is assembled from two parts 74 and 76 that are connected to each other for relative pivotal movement for opening and closing the box. Part 74 includes a partial bottom 78, front wall 80 and end walls 82. Extending inwardly from adjacent the rear of each end wall 82 is an integrally formed pin 84. Mating part 76 includes a partial bottom 88, a back wall 90, a top 92 and partial end panels 94. Adjacent the rear of each panel 94 is a hole 96. With parts 74 and 76 positioned to form a box, pins 84 are aligned with, and received in, holes 96 permitting relative pivotal movement of parts 74 and 76.

Figure 3:
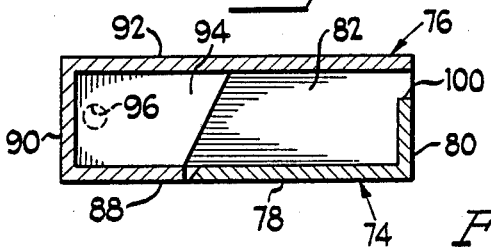
FIG. 3 is an enlarged scale, sectional view taken generally along line 3—3 of FIG. 2.
Figure 4:
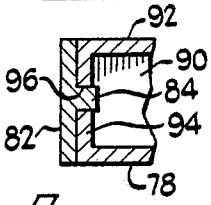
FIG. 4 is an enlarged scale, fragmentary sectional view taken generally along line 4—4 of FIG. 2.
Figure 6:
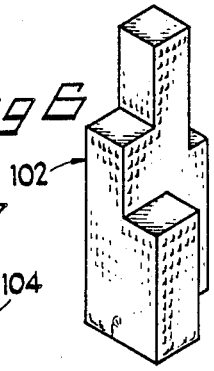
FIG. 6 is a perspective view of a marker used in the embodiment.
Figure 7:
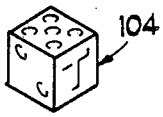
FIG. 7 is a perspective view showing three sides of a die used in the embodiment.

As is best appreciated from FIGS. 2 and 3, front wall 80 is shorter than back wall 90 so that front wall 80 does not abut top 92 but rather leaves an open slot 100 through which any of the pieces of simulated money 60 may be inserted into box 70. When box 70 is closed, as in FIG. 2, the amount of money in the box may not be readily discerned. However, upon opening the box, the amount of money may be easily determined as illustrated in FIG. 5.

Each player is provided with a token or marker 102 distinguishable from the others by color or the like. A six-sided die 104 is also provided. Die 104 has one of the numbers one through five on one of each of five of its faces and a capital letter "T" on the sixth face.

Figure 8:
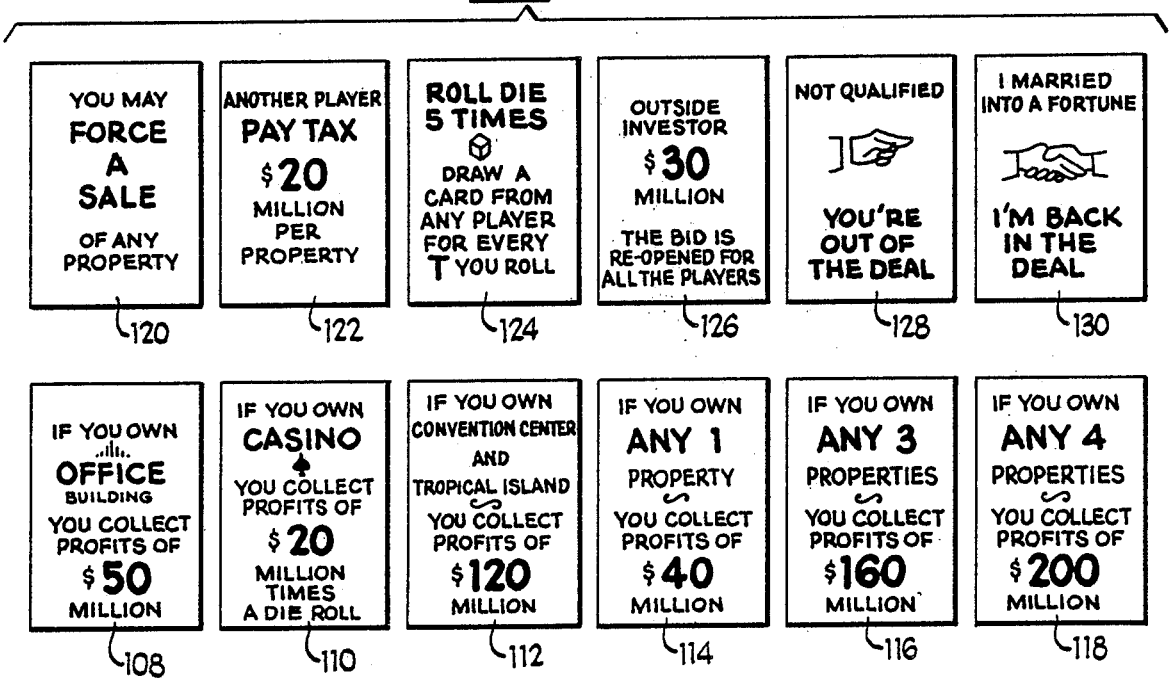
FIG. 8 is an enlarged scale, top plan view of the faces of exemplary cards used in the embodiment.

Exemplary faces of cards 50 are illustrated in FIG. 8. Of the seventy-two cards, thirty-two of the cards permit players to collect profits depending on their property holdings. There are eight cards, one for each of the properties, that, like card 108, permit a player to collect profits of a specific amount ranging from $30 to $60 Million if the player owns the specific property designated on the card. An additional eight cards, one for each of the properties, like card 110, entitle a player to collect a profit of a designated amount times a die roll, if the player holding the cards owns the specific property identified on the card. In addition, there are eight cards which, like card 112, permit the player to collect a specific amount of profit if the player owns two specifically identified properties. Each card like 112 uses a different pair of properties and each property appears on two of such cards. The two properties paired together on a card such as 112 are located near each other on the board. Profits of $60 to $120 Million are obtainable with such paired property cards of which there are eight.

Yet another five cards, like card 114, allow a player to collect profits of from $40 to $50 Million if the player owns any one of the eight properties. Two cards 116 permit the collection of profits of $160 Million if the player owns any three of the eight properties. A single card 118 provides for collection of the single biggest profit if the player owns any four of the eight properties.

The deck of cards also includes four cards 120 that, like spaces 44 on the board, permit a player to force a sale of any property. Card 122, of which there are four, requires another player on whom the card is played by the player holding the card to pay a tax of $20 Million for each property owned by the other player to the player holding the card. Two cards 124 direct the player to roll die 104 five times and to take a card, without seeing the face of the card, from the hand of any player for every "T" rolled.

Thirty of the remaining cards are used only in bidding for the acquisition of properties. Of these thirty cards, twelve cards, like "Outside Investor" card 126, allow a player to raise a bid on a property without having to use any of the player's own money and also opens further bidding for all players. The twelve "Outside Investor" cards 126 range in value from $20 Million to $60 Million. Thirteen cards 128 permit a player holding and playing the card to knock an opponent out of the bidding for a property. Once a "You're Out Of The Deal" card 128 is used against a player, that player may not reenter the bidding for that sale unless the player has, and is able to play, an "I'm Back In The Deal" card 130 of which there are five.

To set up the game, one of each of property boxes 70 is placed on its matching property space 16–30 and a $50 Million dollar bill is taken from the bank and placed into the box through slot 100. Each player is then provided with $400 Million in cash from the bank. Cards 50 are shuffled and five of the cards are dealt face down to each player. These five cards, along with others obtained during the course of play, are kept in the player's hand and not disclosed to the opponents. The remainder of the deck of seventy-two cards is placed face down in section 56 of tray 54 as a draw pile.

Each player selects a different color marker 102 and places it on the start space 32. After the initial start, when a player lands on space 32, the player may take one of cards 50 from each player's hand. To determine which player will start, each player rolls die 104 once. Whoever rolls the highest, with "T" being higher than "5", goes first. In case of a tie, the tied players roll again. The remaining order of play is determined by the clockwise position of the players as they are seated about the game.

In the first phase of playing the game, each player's turn begins by drawing a card 50 from the stack in section 56 of tray 54. The player must draw a card before taking the next part of the turn or else the player loses the opportunity to draw a card on that turn. After drawing a card, the player has the option of either rolling die 104 or playing a card, including the card just drawn at the beginning of the turn, held in the player's hand. Should a player elect to play a card rather than rolling the die, the player's marker 102 is not moved. Instead, the player does as directed by the card played which is then placed in discard section 58 of tray 54.

If the player decides to roll the die and "T" comes up, the player is entitled to take a card from any other player's hand, without seeing the face of the card, and then roll the die again. As long as a player keeps rolling "T", the player can continue to collect cards from opponents and get another roll of the die. In view of the value of the cards, opponents should be prevented from accumulating too many. Accordingly, upon rolling a "T", it is generally good strategy to take a card from the opponent that is holding the most. Once a number comes up on a die roll, the player moves the number of spaces along path 12 shown on the die and then follows the instruction on the space to which the player's marker 102 has been moved. A player can pass over and land on spaces already occupied by other markers.

There is a graphic legend on each of the property spaces 16–30 as well as on the top of a corresponding box directing the players to increase the value of the property $10 Million. Accordingly, whenever a player's marker lands on a property, whether it is owned or unowned, $10 Million dollars is taken from the bank and put into the box for that property through slot 100. Property values are also increased whenever a player lands on either of the two spaces 38 or space 40 which direct the player to add $30 Million to $50 Million to any unowned property of the player's choice. Because box 70 is opaque and slot 100 limits the view of the interior of the box, players cannot readily discern how much money is in any particular property box as play of the game proceeds unless they have kept careful track of it.

Upon landing on space 36, the player rolls the die and gets $20 Million times the number rolled from the bank. If the player rolls a "T", the player is entitled to pick a card at random from any opponent and then roll again to see how much money can be acquired from the bank. Landing on space 42 permits a player to exchange a property the player then owns for any property owned by an opponent or any unowned property on the board. If the player landing on space 42 does not own a property, then no trade can be made. However, it is not mandatory for the player to trade any property that the player does own. In a trade for an unowned property, the property that the trading player owned is returned to its designated space on the board and is again unowned.

As soon as a player performs the directed action of any of spaces 32, 36, 38, 40, or 42, the player's turn is over. However, if a player lands on a "For Sale" space 34 or 44, or plays a "Force A Sale" card 120, another entertaining aspect of the game begins.

The player landing on any one of the three spaces 34 may select any unowned property to be put up for sale. However, the player landing on space 44 or playing a card 120 may put up any property, including one already owned by the player or by an opponent, for sale. Besides selecting the property to be sold, the player landing on any of the spaces 34 or 44 or playing card 120 acts as the "broker". To start a sale, the broker removes the appropriate property box 70 from its position on path 14 from in front of the player or from in front of the opponent that owned the property, and places it in the center of board 12. Any markers 102 that are on top of the property box are placed on the matching space. All players are then entitled to make an opening bid on the property.

Without revealing the amount to their opponents, each player sets aside an amount of money for their opening bid. A player short on money or otherwise not interested in bidding on a property does not have to bid. However, it is usually advantageous to make at least a minimum $10 Million bid because if no opening bid is made, the player is excluded from participating in subsequent bidding on that sale. After a suitable length of time for all the players to ready their opening bids, the player acting as broker requests that all players simultaneously expose the amount of money set aside for their bids. Beginning with the broker, players proceed clockwise to announce their opening bids. In case of a tie, the first clockwise player to make the tied bid is considered to have the highest opening bid.

Once the high bidder is determined, the other players, starting with the broker, have one turn in which to play an "Outside Investor" card 126 or a "You're Out Of The Deal" card 128; if none of those cards are played, the high bidder gets the property. Should a player be knocked out of the bidding by the play of a "You're Out Of The Deal" card 128 on the player, the player will have an opportunity on the player's own turn to get back in with an "I'm Back In The Deal" card 130. A player that is knocked out of the bidding cannot knock any other players out of the bidding unless the player gets back in the bidding by playing a card 130.

Playing an "Outside Investor" card 126 requires a player to raise the player's prior bid by all of the amount indicated on the card, which is provided in cash by the bank. In addition, the player may add any amount of additional cash from the player's own hand to the bid. All bidding is done in minimum increments of $10 Million. Another effect of playing a card 126 is that the bidding is then reopened for all players; no player can increase the opening bid until someone plays an "Outside Investor" card. After an "Outside Investor" card 126 is played, any player may increase a bid using only cash held by the player or by playing another card 126. During the course of bidding, no player would know with certainty the value of an unowned property unless the player has kept very careful watch of all money inserted through slot 100. In the case of a forced sale of an owned property, only the owner would know the amount in the box since the owner is entitled to look inside to determine the amount.

In bidding on a piece of property, players may be willing to bid more than they think is contained in box 70 if they hold any profit cards 108–118 which they could cash in upon acquiring the property up for sale. On any turn during bidding on a property, a player may elect to pass. However, once all of the players have consecutively passed, the bidding is over and the highest bidder that is still in the bidding gets the property and takes possession of the property box. All bidding cards 126–130 played during the course of the sale are placed face up in section 58 of tray 54.

The high bidder's money is payed to the bank if the property was unowned and to the prior owner if owned. When the prior owner is the highest bidder in a forced sale and reacquires the property, the amount bid must be put into the property box. All unsuccessful bidders get their entire bid returned including any money added to the bid by the play of one or more "Outside Investor" cards. Upon acquiring the property, the owner opens box 70 and reveals the amount of money contained inside to all of the other players. Although the owner can look inside any time the owner wants, the amount never has to be revealed to the opponents again, unless, of course, the property is sold again.

Sometimes the draw pile of cards 50 in section 56 of tray 54 will run out before all eight of the properties are sold. In that event, the player that drew the last card completes the turn initiated by that draw. Immediately afterwards, that player then becomes the broker and puts all of the remaining properties up for sale, one at a time, in any order chosen by the broker, until all are sold.

As soon as the last property has been purchased from the board, the first or buying phase is over. The second and final dealing phase then begins. In the second phase, the game board is no longer used and there is no pile of cards from which to draw. Players compete in this final phase using only the properties they own, the money they have, the cards in their hand and, of course, their wits. The player that bought the last piece of property gets the first turn in the second phase. On each turn, the player may: play a card from the player's hand, which ends the turn; propose a deal which ends the player's turn whether the deal is rejected or made; or pass.

All of the cards that were used in the first phase may still be used in the second phase. However, since there no longer is any movement along the board path, sale of a property will only occur if a player plays a "Force A Sale" card 120. In the absence of any sale, cards 126, 128 and 130 that are used solely to effect the bidding, are useless in the player's hand.

Deals may be made with opposing players in the second phase for the sale, trade, loan or gift of cards and/or property. Haggling on price is, of course, permitted, but it must be done quickly. A player to whom a deal is offered may accept the deal, reject the deal, or make a counteroffer. Rejection of a deal ends the turn of the player offering the deal. While it may be tempting to start making deals as soon as the second phase begins, it may be a better strategy for a player to first play the cards in the player's hand before an opponent may, playing a "Roll Die 5 Times" card 124 roll a "T" and take away the valuable card.

Lying to another player or intentionally breaking a promise relating to a deal is not allowed. However, there are situations that may occur that prohibit a player from fulfilling a promise made during the course of a deal. For example, a player needing a property in order to cash in a profits card may make a deal with the opponent owning the needed property to purchase the property conditioned on a promise to sell the property back to the original owner on the next turn; before the player can fulfill the promise to return the property, a third player forces the sale of the property.

At some point, players either run out of cards or give up on making deals with the cards and properties that they have. Once all of the players consecutively pass, the game is over. All players then count up the money in their hands and the money inside the property boxes they own. Cards still held in the players' hands are worthless at this point; they are not counted in determining the winner. The player with the most money is the winner.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A game for a number of players comprising in combination:

means defining a path of spaces;

some of the spaces representing properties;

the spaces not representing properties containing directions affecting play of the game;

a supply of simulated money;

an opaque container for each of the properties;

each container being identified with and removably fitting on a space representing a particular property;

each container having a slot through which a piece of the money may be inserted;

each container being capable of holding a number of pieces of the money while obscuring the total amount of the money being held in the container; and means for obtaining access to the interior of the container to determine the amount of the money contained in the box.

2. The game of claim 1 in which each container has an outline in plan view that substantially conforms to a property space.

3. The game of claim 1 in which the property spaces are of a different shape than the directional spaces

4. The game of claim 3 in which each container has an outline in plan view that substantially conforms to a property space.

5. A method of playing a game by a number of players comprising the steps of:

providing a path of spaces for the players to move along including spaces representing properties to be acquired and spaces with directions that affect play of the game;

supplying a quantity of simulated money and initially allocating an amount of that money to each player;

furnishing a deck of cards containing directions affecting play of the game and initially dealing a predetermined number of such cards to each of the players;

equipping each property space with an opaque container having a slot for insertion of pieces of the money;

permitting each player in turn to operate a chance device to move along the path or play a card held by the player;

requiring each player landing upon a property space to insert a specified amount of money into the container; and directing the sale of a property to occur by bidding among all of the players upon any one player landing upon a space directing sale or playing a card directing sale.

6. The method of claim 5 in which the bidding includes the steps of:

making an initial secret opening bid to determine the high bidder; and awarding the property being sold to the high bidder upon a round of consecutive passes by all of the players.

7. The method of claim 6 including the step of permitting a player to reopen the bidding by playing a particular one of the cards.

8. The method of claim 6 including the step of permitting a player to knock out the high bidder by playing a particular one of the cards.

9. The method of claim 5 including the additional steps of:

entering into a second phase of the game once all of the properties represented by the spaces has been sold;

omitting the step of moving along a path during a turn;

allowing each player to enter into a deal with any other player for the sale, trade, loan or gift of property and/or cards;

terminating play upon each of the player's consecutively failing to play a card held by the player or make a deal; and determining a winner based on the total amount of money held by the player and in the containers for each property owned by the player.

10. A method of playing a game comprising the steps of:

initially proceeding around a path of spaces including spaces representing properties to be acquired;

directing the sale of a property to occur upon any one player landing upon a space in the path directing sale or upon playing a card directing sale;

entering into a second phase of the game once all of the properties represented by the spaces has been sold;

omitting the step of moving along a path during a turn;

allowing each player to enter into a deal with any other player for the sale, trade, loan or gift of property and/or cards;

terminating play upon each of the player's consecutively failing to play a card held by the player or make a deal; and determining a winner based on the total amount of money held by the player and in the containers for each property owned by the player.

* * * * *